US008514137B2

(12) United States Patent
Tateno

(10) Patent No.: US 8,514,137 B2
(45) Date of Patent: Aug. 20, 2013

(54) COMPOSITE ANTENNA DEVICE

(75) Inventor: Kouichi Tateno, Bunkyo-ku (JP)

(73) Assignee: Clarion Co., Ltd., Tokyo (JP)

( * ) Notice: Subject to any disclaimer, the term of this patent is extended or adjusted under 35 U.S.C. 154(b) by 297 days.

(21) Appl. No.: 12/988,752

(22) PCT Filed: Apr. 20, 2009

(86) PCT No.: PCT/JP2009/001800
§ 371 (c)(1),
(2), (4) Date: Oct. 20, 2010

(87) PCT Pub. No.: WO2009/130879
PCT Pub. Date: Oct. 29, 2009

(65) Prior Publication Data

US 2011/0043420 A1 Feb. 24, 2011

(30) Foreign Application Priority Data

Apr. 25, 2008 (JP) ..... 2008-115698

(51) Int. Cl.
*H01Q 21/00* (2006.01)

(52) U.S. Cl.
USPC ..... 343/725; 343/715; 343/900

(58) Field of Classification Search
USPC ..... 343/725, 711, 712, 713, 715, 700 MS, 343/900
See application file for complete search history.

(56) References Cited

U.S. PATENT DOCUMENTS

| | | | | |
|---|---|---|---|---|
| 4,151,531 | A * | 4/1979 | Kaloi | 343/700 MS |
| 5,959,585 | A | 9/1999 | Militz | |
| 2003/0197651 | A1* | 10/2003 | Yuanzhu | 343/725 |
| 2004/0227677 | A1* | 11/2004 | Asano et al. | 343/702 |

FOREIGN PATENT DOCUMENTS

| | | |
|---|---|---|
| JP | 04-306007 | 10/1992 |
| JP | 09-153713 | 6/1997 |
| JP | 10-107542 A | 4/1998 |
| JP | 2000-068722 | 3/2000 |
| JP | 2001-251136 | 9/2001 |
| JP | 2004-304461 | 10/2004 |
| JP | 2005-045335 A | 2/2005 |
| JP | 3727351 | 10/2005 |
| JP | 2007-013273 | 1/2007 |

OTHER PUBLICATIONS

International Preliminary Report on Patentability issued in International Patent Application No. PCT/JP2009/001800, dated Dec. 13, 2010.

Office Action issued in Japanese Patent Application No. 2010-509071 dated Dec. 11, 2012.

Office Action issued in Chinese Application No. 2012103000991740 mailed Nov. 2, 2012.

* cited by examiner

*Primary Examiner* — Dieu H Duong

(74) *Attorney, Agent, or Firm* — McDermott Will & Emery LLP

(57) ABSTRACT

A composite antenna device includes a rod antenna for receiving AM/FM radio broadcasting and a patch antenna for a radio wave of satellite broadcasting that is transmitted from a satellite and is higher than the AM/FM broadcasting, the patch antenna is arranged side by side at a position with a distance from the rod antenna shorter than a wavelength of the radio wave of the satellite broadcasting, and a feeding point that supplies power to the patch antenna is provided at a position displaced from a front end of the patch antenna only by a length according to a distance L between the antennas.

5 Claims, 7 Drawing Sheets

COMPOSITE ANTENNA DEVICE

RELATED APPLICATIONS

This application is the U.S. National Phase under 35 U.S.C. §371 of International Application No. PCT/JP2009/001800, filed on Apr. 20, 2009, which in turn claims the benefit of Japanese Application No. 2008-115698, filed on Apr. 25, 2008, the disclosures of which Applications are incorporated by reference herein.

TECHNICAL FIELD

The present invention relates to a composite antenna device that can receive radio waves of different frequency bands and particularly to a composite antenna device provided with a rod antenna and a patch antenna.

BACKGROUND ART

In general, in a vehicle such as an automobile, a rod antenna for receiving AM/FM radio broadcasting is known. Also, a composite antenna device provided with this type of rod antenna and a patch antenna for receiving a radio wave of frequency higher than that of the AM/FM radio broadcasting such as a GPS signal from a GPS (Global Positioning System) satellite and satellite broadcasting transmitted from a satellite (SDARS (Satellite Digital Audio Radio Service) satellite, for example), in which the rod antenna and the patch antenna are made into a unit has been recently proposed (See Patent Document 1, for example).

PATENT LITERATURE

Patent Document 1: JP-A-2007-13273

SUMMARY OF INVENTION

Technical Problem

Since this type of composite antenna device is installed on a roof of a vehicle such as an automobile, improvement of reception sensitivity and size reduction of the antenna device are in demand.

However, if the size reduction of the antenna device is to be realized, since the rod antenna is arranged close to the patch antenna, this rod antenna functions as a metal obstruction and is expected to lower reception performance (gain) of the patch antenna. Therefore, in a prior-art device, a distance between the patch antenna and the rod antenna is made at least larger than a length of one wavelength (λ) of the radio wave received by the patch antenna in order to reduce a physical influence of the rod antenna, and there is a problem that the size of the composite antenna device is increased.

Thus, the present invention was made in order to solve the above-described problems and has an object to provide a composite antenna device whose size is reduced while reception performance of a patch antenna is maintained.

Solution to Problem

In order to solve the above-described problems, the present invention includes a rod antenna for receiving a radio wave of a first frequency band and a patch antenna for receiving a radio wave of a second frequency band higher than the first frequency band, in which the patch antenna is arranged side by side at a position with a distance from the rod antenna shorter than the wavelength of the radio wave of the second frequency band, and a feeding point that supplies power to the patch antenna is disposed at a position displaced from one end of the patch antenna by a length corresponding to the distance between the antennas.

According to this configuration, since the patch antenna is arranged side by side at the position with the distance from the rod antenna shorter than the wavelength of the radio wave of the second frequency band, the patch antenna and the rod antenna can be arranged close to each other, and the size of the composite antenna device can be reduced. Also, since the feeding point that supplies power to the patch antenna is disposed at the position displaced from one end of the patch antenna only by a length corresponding to the distance between the antennas, even if a physical influence of the rod antenna is applied, impedance at the feeding point can be matched with a reference value (50Ω, for example) easily. Therefore, even if the patch antenna is disposed at the position with the distance from the rod antenna shorter than the wavelength of the radio wave of the second frequency band, the physical influence of this rod antenna can be reduced, and reception performance of the patch antenna can be maintained.

Also, in this configuration, supposing that a distance between the antennas is L and a specific permittivity of the patch antenna is ∈r, length Y to displace the feeding point may be configured so as to satisfy the following formula:

$$Y \cong L/\in r^{1/2}$$

Also, a supporting member that supports the patch antenna is provided so that a distance between a base plate on which the composite antenna device is mounted and the patch antenna is to be a distance where a value of an induced voltage generated in the patch antenna becomes substantially the maximum.

Also, a distance between a base plate on which the composite antenna device is mounted and a feeding portion of the rod antenna may be configured to be set such that the feeding portion of the rod antenna does not extend into a predetermined elevation angle range that satisfies antenna directivity performance of the patch antenna.

Also, the first frequency band may be configured to include a frequency band of a radio wave of AM/FM radio broadcasting. Also, the second frequency band may be configured to include a frequency band of a radio wave of satellite broadcasting transmitted from a satellite.

Advantageous Effects of Invention

According to the present invention, the size of the composite antenna device can be reduced while reception performance of the patch antenna is maintained.

DESCRIPTION OF EMBODIMENT

Figure 1:
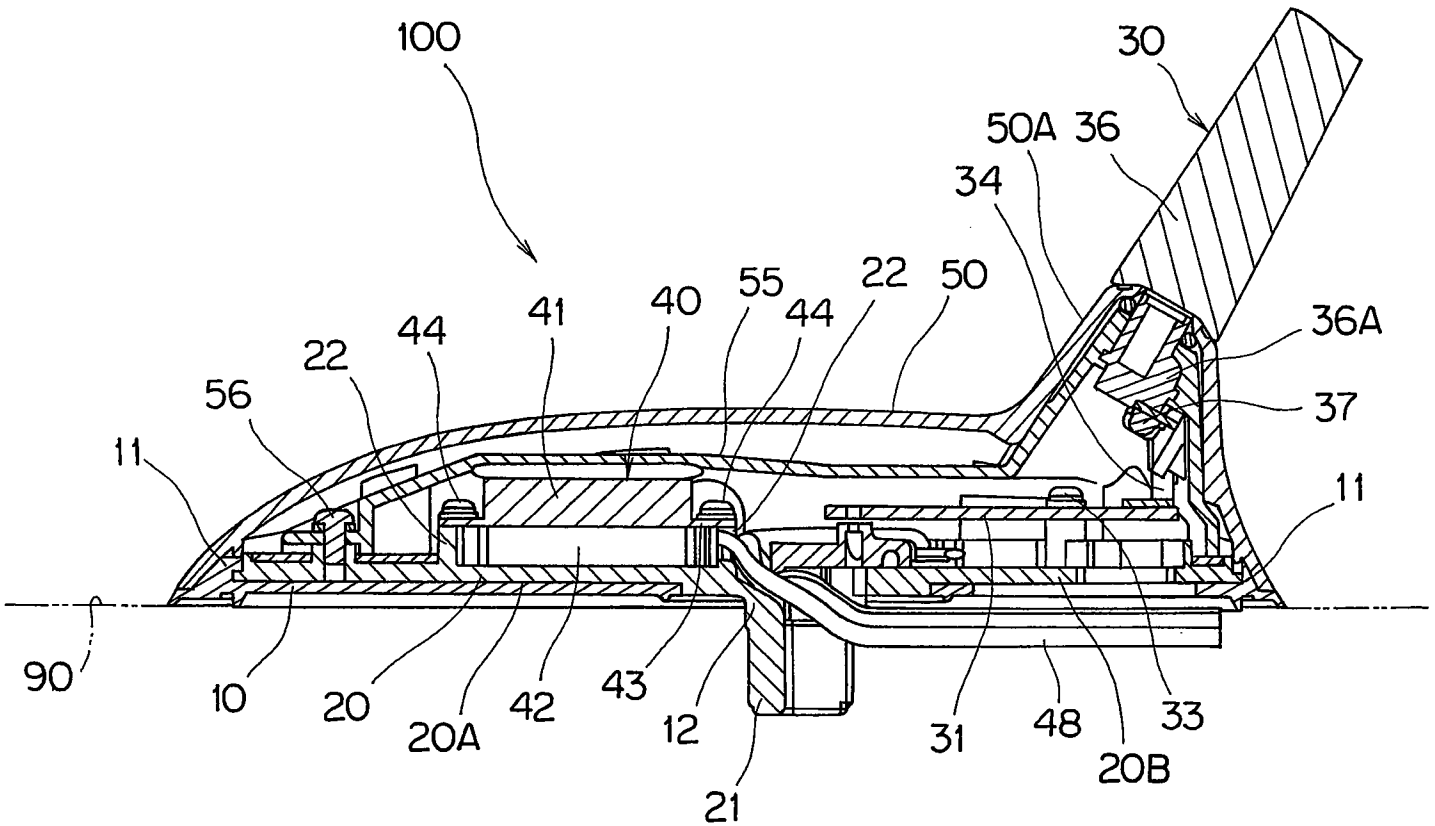
FIG. 1 is a side sectional view of an antenna unit of this embodiment.

FIG. 1 is a side sectional view of an antenna unit 100 of this embodiment. The antenna unit 100 is mainly mounted on a roof panel of a vehicle such as an automobile, and as shown in FIG. 1, the antenna unit 100 includes a base plate 10 arranged on a roof panel 90 (base plate) of a vehicle, a die-cast base (supporting member) 20 arranged on the base plate 10 and supporting various components, a rod antenna 30 that receives a radio wave of AM/FM radio broadcasting as a first frequency band, a patch antenna 40 that receives satellite radio broadcasting transmitted from an SDARS satellite of a frequency band higher than that of the AM/FM radio broadcasting as a second frequency band, and a case body 50 that covers the die-cast base 20, the rod antenna 30, and the patch antenna 40.

The base plate 10 is formed by an elastic resin material and is provided with a ring-shaped wall portion 11 protruding upward on the outer peripheral edge thereof. Also, a circular opening 12 is formed substantially at the center of the base plate 10.

The die-cast base 20 is formed by casting materials such as zinc, aluminum, magnesium and the like, and a columnar boss portion 21 protruding to the outside through the opening 12 in the base plate 10 is formed on the back face side thereof. This boss portion 21 is inserted into a hole portion disposed in the roof panel 90 of the vehicle and functions as a mounting portion to this roof panel 90 and also functions as earth of the rod antenna 30 and the patch antenna 40 communicating with the die-cast base 20.

Figure 2:
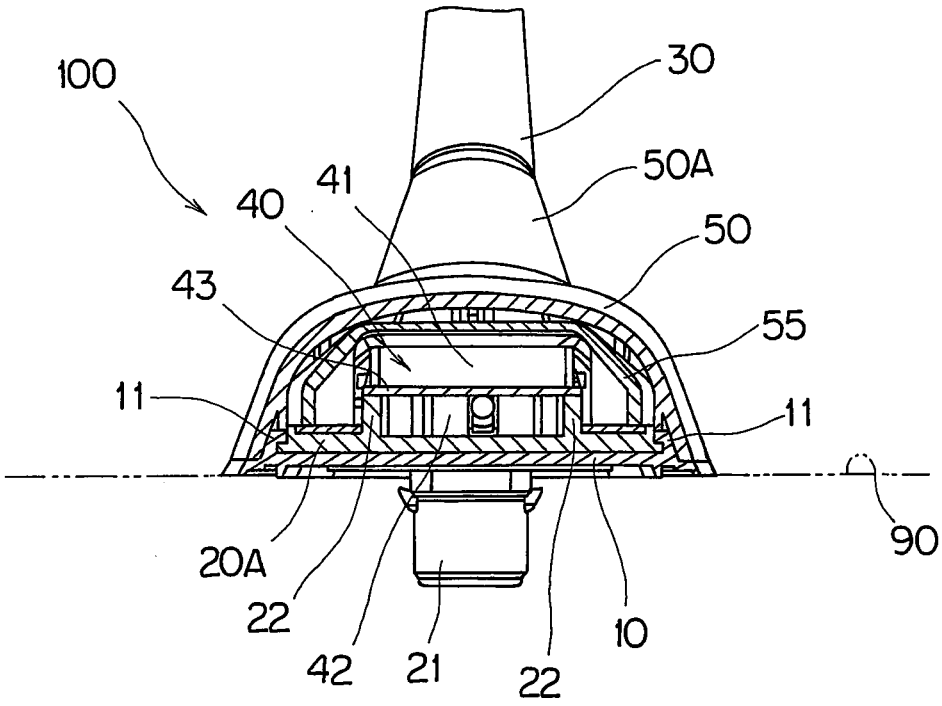
FIG. 2 is a sectional view of the antenna unit at a front end portion.

On a front-end (one end) 20A side of the die-cast base 20, as shown in FIGS. 1 and 2, a rectangular supporting wall portion 22 protruding upward from the bottom face thereof is formed, and the patch antenna 40 is fixed onto the supporting wall portion 22. This patch antenna 40 includes an antenna element board 41 and an LNA circuit board 42 mounted on the back face side of this antenna element board 41. A flange portion 43 is formed around the antenna element board 41, and this flange portion 43 and the supporting wall portion 22 of the die-cast base 20 are fastened by a screw 44. In this configuration, the LNA circuit board 42 is accommodated in a space surrounded by the supporting wall portion 22.

The antenna element board 41 receives satellite radio broadcasting from the SDARS satellite and is formed by affixing an antenna element formed by metal on a board formed by a dielectric body such as ceramics. Also, the antenna element board 41 has an element length of the antenna element set to a length corresponding to ½ wavelength (½λ). The LNA circuit board 42 amplifies a signal received at the antenna element board 41. The LNA circuit board 42 and the antenna element board 41 are connected by a feeding point that supplies power to the antenna element board 41. The satellite radio broadcasting of this embodiment is digital radio broadcasting that receives a radio wave whose frequency is in an approximately 2.3 GHz band and which is transmitted from the SDARS satellite and is currently in practical use in the United States. In this embodiment, since a frequency f of the received radio wave is an approximately 2.3 GHz band, the received wavelength (resonant wavelength) λ is approximately 130.4 mm.

Figure 3:
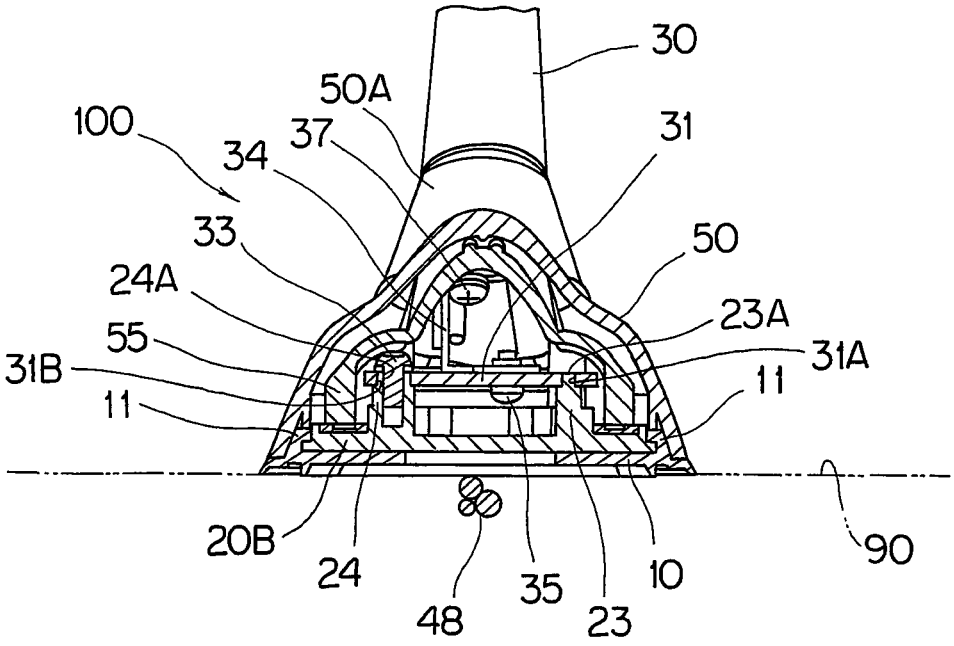
FIG. 3 is a sectional view of the antenna unit at a rear end portion.

On the other hand, on a rear end (another end) 20B side of the die-cast base 20, as shown in FIG. 3, a right and left pair of supporting portions 23 and 24 are formed, and a booster circuit board 31 of the rod antenna 30 is fixed onto the supporting portions 23 and 24. The booster circuit board 31 amplifies a signal received at the rod antenna 30. In the booster circuit board 31, a screw hole 31A and a locking hole 31B are formed, a locking piece 23A formed at the distal end of the one supporting portion 23 is inserted into the locking hole 31B, a screw 33 is inserted into the screw hole 31A, and the screw 33 is screwed to a screw receiving portion 24A formed in the other supporting portion 24.

Also, to the booster circuit board 31, one end of a connection plate 34 bent substantially in the L-shape is fixed by a screw 35, while the other end of the connection plate 34 is connected to a feeding portion 37 formed on a base end portion 36A of an antenna element 36 of the rod antenna 30.

Also, to the LNA circuit board 42 and the booster circuit board 31, output cables 48 are connected, respectively, and the output cables 48 are connected to a radio receiver (not shown) mounted on the vehicle.

The case body 50 is formed by an elastic resin material and as shown in FIG. 1, covers various components such as the antenna element board 41, the LNA circuit board 42, the antenna element 36, the connection plate 34 and the like arranged on the die-case base 20 in collaboration with the base plate 10, and water tightness inside the case body 50 is ensured by arranging waterproof packing, not shown, in a joining portion between the base plate 10 and the case body 50. Also, a rear end portion 50A of the case body 50 is formed expanding upward, and the base end portion 36A of the antenna element 36 of the rod antenna 30 is accommodated therein. Also, on the rear end portion 50A of the case body 50, the antenna element 36 continuing to this base end portion 36A is mounted. In this embodiment, the antenna element 36 of the rod antenna 30 is disposed with the distal end portion thereof inclined in a direction away from the patch antenna 40.

Also, in this embodiment, a cover body 55 is arranged between the case body 50 and the die-cast base 20, and this cover body 55 is fixed by a screw 56 to the die-cast base 20. According to this, since the case body 50 is made capable of being mounted with a structure separate from the cover body 55, a color tone can be applied by painting or the like and various designs can be added to the surface of the case body 50. For that purpose, the structure of an antenna main body including the cover body 55 can be made common without change.

In the antenna unit 100 of this embodiment, the antenna element board 41 of the patch the antenna 40 and the antenna element 36 of the rod antenna 30 are arranged side by side on the die-cast base 20. Since this type of the antenna unit 100 is arranged on the roof panel 90 of a vehicle such as an automobile, improvement of reception sensitivity and size reduction of the antenna unit 100 are in demand.

However, if the size reduction of the antenna unit 100 is to be realized, since the antenna element 36 of the rod antenna 30 is arranged close to the antenna element board 41 of the patch antenna 40, the antenna element 36 functions as a metal obstruction and is expected to lower reception performance (gain) of the patch antenna 40.

On the other hand, if the antenna element board 41 of the patch antenna 40 is arranged largely away (larger than the length of one wavelength (λ) of a radio wave received by the patch antenna 40, for example) from the antenna element 36 of the rod antenna 30, though the drop in the reception performance of the patch antenna 40 can be suppressed, the size reduction of the antenna unit 100 cannot be realized.

In this configuration, an arrangement structure to realize the size reduction of the antenna unit 100, while the reception performance of the patch antenna 40 is maintained, has a characteristic. Thus, the arrangement structure of the patch antenna 40 and the rod antenna 30 will be described.

First, a distance between the patch antenna 40 and the roof panel 90 will be described.

In general, in the patch antenna 40, it is known that a radiation pattern is formed by voltage radiation of an induced voltage induced in the antenna element board 41 of the patch antenna 40, and at this time, it was found out through experiments and the like by the applicant that directivity of the patch antenna 40 depends on a distance H1 (See FIG. 4) between the antenna element board 41 and the roof panel 90 as a metal base plate located immediately below this antenna element board 41.

Figure 5A:
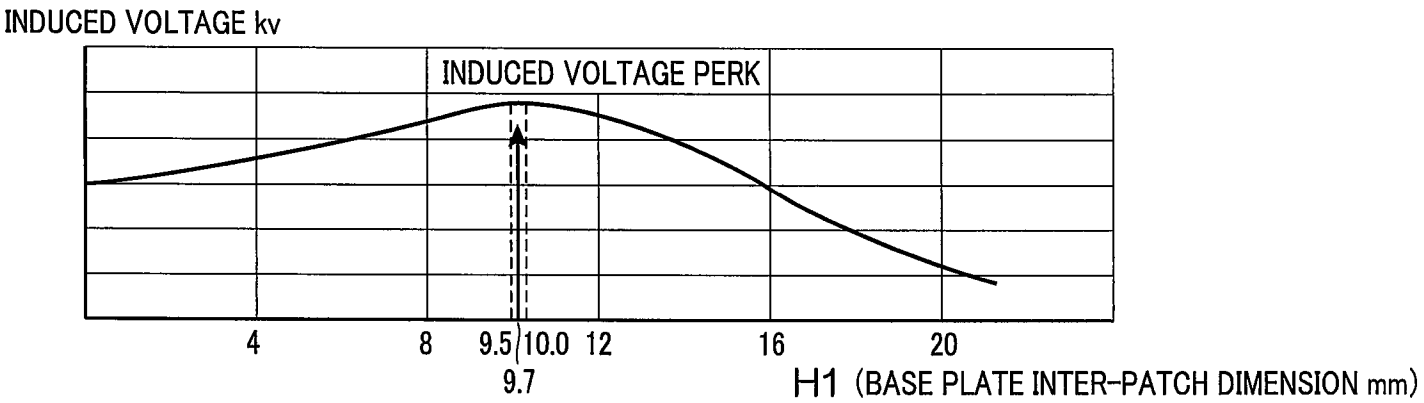
FIG. 5A is a graph illustrating a relationship between a distance between the patch antenna and a roof panel and a value of an induced voltage induced in the patch antenna.
Figure 5B:
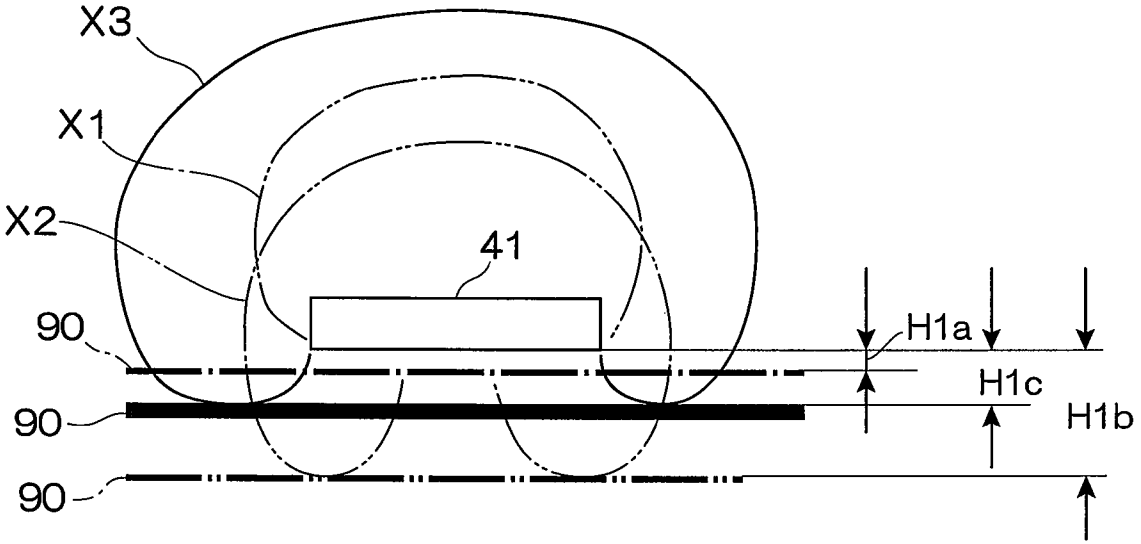
FIG. 5B is a schematic diagram illustrating a relationship between the distance between the patch antenna and the roof panel and a radiation pattern of the induced voltage.

Specifically, if the distance H1 between the antenna element board 41 and the roof panel 90 is too short (FIG. 5B: H1=H1*a*), as shown in FIG. 5A, since the induced voltage is low, bounce of this induced voltage to the roof panel 90 is small, and as shown in FIG. 5B, a radiation pattern X1 has narrow directivity. Thus, the antenna directivity becomes narrow, and antenna performance is deteriorated.

On the other hand, if the distance H1 becomes long (FIG. 5B: H1=H1*b*), the induced voltage is lowered, and as shown in FIG. 5B, the induced voltage becomes a radiation pattern X2 going between the antenna element board 41 and the roof panel 90. In this case, the induced voltage and a ground wave (or a satellite wave) bounced by the roof panel 90 cancel each other, directivity at a low angle cannot be obtained, and antenna performance at a low elevation angle is deteriorated.

In this embodiment, as shown in FIGS. 5A and 5B, the supporting wall portion 22 of the die-cast base 20 is formed at a predetermined height in order to arrange the antenna element board 41 so that the distance H1 between the antenna element board 41 and the roof panel 90 is to be a distance H1*c* (in this embodiment, the distance H1*c* is set preferably to 9.5 to 10.0 mm and more preferably to 9.7 mm) where the induced voltage generated in the antenna element board 41 becomes the maximum value. As a result, as shown in FIG. 5B, an appropriate radiation pattern X3 can be formed, and the antenna directivity is wide, and the antenna performance can be improved. Moreover, as mentioned above, the supporting wall portion 22 is formed protruding in the rectangular shape from the bottom face of the die-cast base 20, and the antenna element board 41 is fixed to the upper end of this supporting wall portion 22. Thus, the induced voltage generated in the antenna element board 41 is prevented from going below the antenna element board 41, and the appropriate radiation pattern as mentioned above can be realized.

Figure 4:
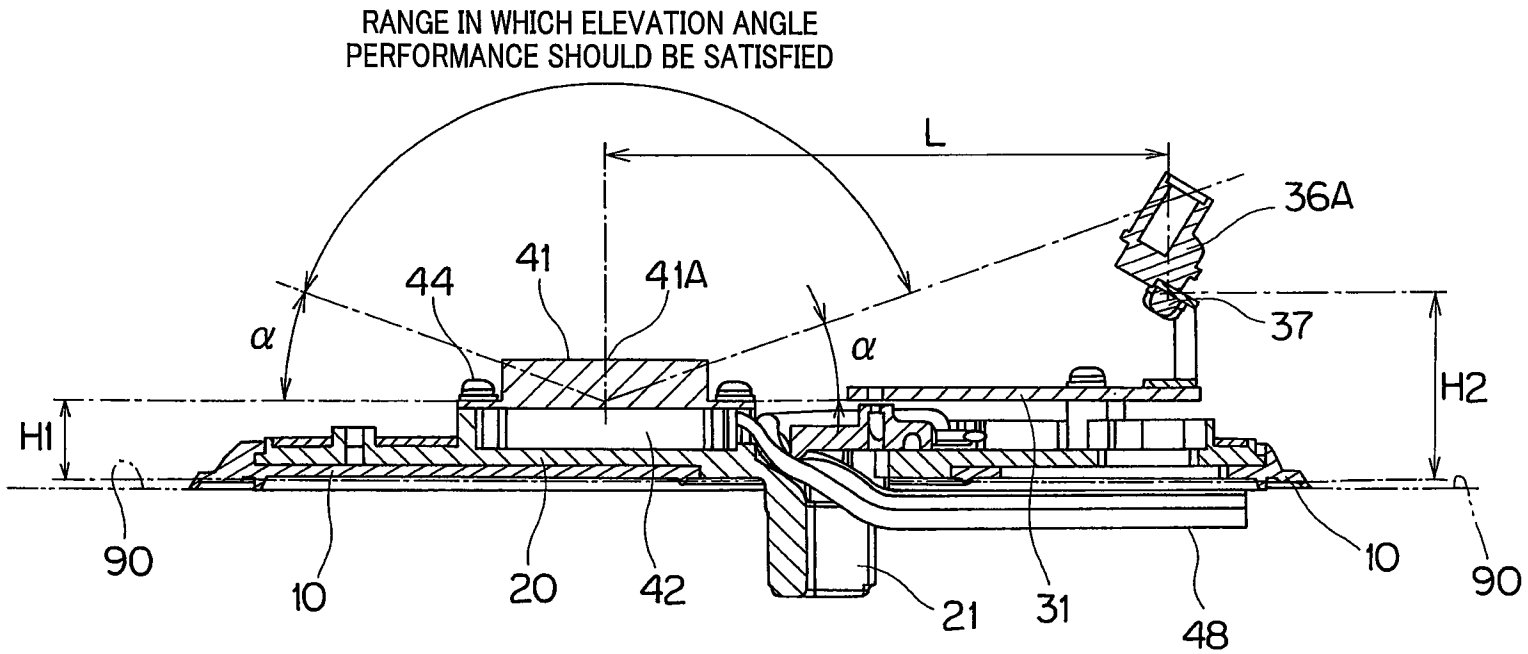
FIG. 4 is a view illustrating an arrangement relationship between a patch antenna and a rod antenna.

Subsequently, a distance between the feeding portion 37 of the rod antenna 30 and the roof panel 90 will be described. As shown in FIG. 4, in the patch antenna 40 that receives a signal from a satellite, it is required to satisfy stable antenna directivity performance at an angle larger than a predetermined elevation angle α (20 degrees in this embodiment), that is, in a range of 20 to 160 degrees. In this case, since the base end portion 36A and the feeding portion 37 of the rod antenna 30 are formed by a metal body, if the base end portion 36A and the feeding portion 37 are extended into the above range, it causes deterioration in the directivity of the patch antenna 40.

Therefore, in this embodiment, a distance H2 between the feeding portion 37 of the rod antenna 30 and the roof panel 90 is set to a predetermined distance (approximately 21 to 23 mm in this embodiment) so that if the patch antenna 40 is arranged at a position from the rod antenna 30 shorter than the wavelength λ of a signal transmitted from the SDARS satellite, the feeding portion 37 and the base end portion 36A of the rod antenna 30 connected to the feeding portion 37 are not extended into the above-described range, which will be described later.

Subsequently, a distance between the patch antenna 40 and the rod antenna 30 will be described. As mentioned above, a distance L between the patch antenna 40 and the rod antenna 30 is closely related to the reception performance of the patch antenna 40 and the size of the antenna unit 100.

Therefore, if the distance L can be set as short as possible and the drop in the reception performance at that time can be suppressed, the size reduction of the antenna unit 100 can be realized while the reception performance of the patch antenna 40 is maintained.

In this embodiment, while extension of the base end portion 36A of the rod antenna 30 or the feeding portion 37, which becomes a metal obstruction, in the predetermined elevation angle range (20 to 160 degrees) of the patch antenna 40 is suppressed, reduction of the distance L between a center 41A of the antenna element board 41 of the patch antenna 40 and the feeding portion 37 is realized. Specifically, the distance L is set to 65 to 68 mm.

As mentioned above, by setting a ratio among the distance H1 between the antenna element board 41 of the patch antenna 40 and the roof panel 90, the distance H2 between the feeding portion 37 of the rod antenna 30 and the roof panel 90, and the distance L between the center 41A of the antenna element board 41 of the patch antenna 40 and the feeding portion 37 to 1:2:6, a layout that can reduce the size of the antenna unit 100 can be realized while the reception performance of the patch antenna 40 is maintained.

Figure 6:
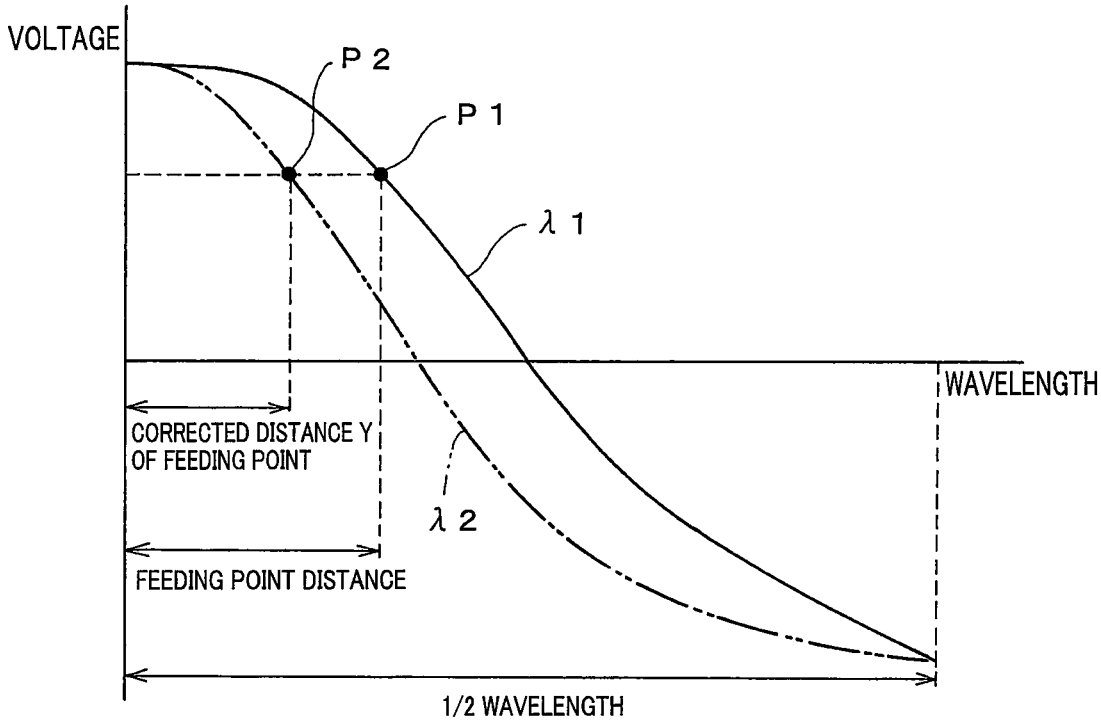
FIG. 6 is a graph illustrating voltage distribution in an antenna element of the patch antenna.

FIG. 6 is a graph illustrating voltage distribution in the antenna element of the patch antenna 40. In this figure, reference character λ1 denotes voltage distribution of the antenna element board 41 in a state in which there is no metal obstruction around the patch antenna 40, and reference character λ2 denotes voltage distribution of the antenna element board 41 in a state in which a metal obstruction is arranged around the patch antenna 40. As shown in FIG. 6, if a metal obstruction is arranged around the patch antenna 40, that is, if the distance L between the center 41A of the antenna element board 41 and the feeding portion 37 of the rod antenna 30 is set to a distance (65 to 68 mm) shorter than the received wavelength λ, (approximately 130.4 mm), the voltage distribution λ2 in the antenna element of the patch antenna 40 is affected by this feeding portion 37.

In this embodiment, by displacing the position of the feeding point of the antenna element board 41 from P1 to P2 according to the distance L between the center 41A of the antenna element board 41 and the feeding portion 37 of the rod antenna 30, the physical influence by the feeding portion 37 can be minimized.

Specifically, the relationship between the distance L between the center 41A of the antenna element board 41 and the feeding portion 37 of the rod antenna 30 and a displacement amount Y of the feeding point P2 can be expressed using the specific permittivity ∈r of the dielectric body of the antenna element board 41 and the frequency f as follows:

$$L/3.0\times10^8/f \cong Y/3.0\times10^8/f/\in r^{1/2} \quad (1)$$

If this formula is organized, the following formula is obtained:

$$Y \cong L/\in r^{1/2} \quad (2)$$

Figure 7:
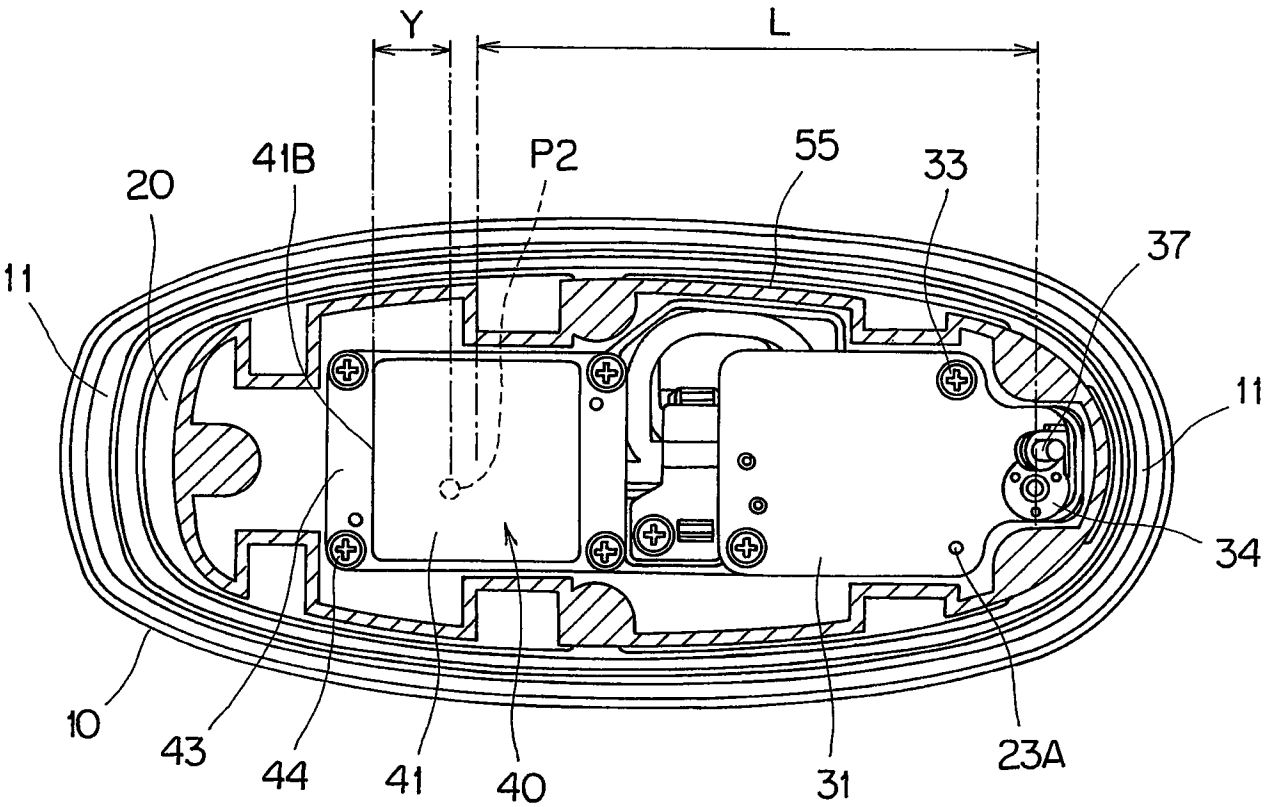
FIG. 7 is a top view illustrating a state in which a feeding point of the patch antenna is displaced.

In this embodiment, as shown in FIG. 7, the feeding point P2 is disposed at a position displaced only by the displacement amount Y acquired from the above formula (2) from one end on the side far from the rod antenna 30 of the antenna element board 41, that is, from a front end 41B of the antenna element board 41. According to this configuration, by changing the feeding point P2 according to the distance L between the center 41A of the antenna element board 41 and the feeding point 37 of the rod antenna 30, impedance at this feeding point P2 can be easily made to match the reference value (50Ω, for example). Therefore, even if the distance L between the center 41A of the antenna element board 41 and the feeding point 37 of the rod antenna 30 is provided at a position so as to become a distance (65 to 68 mm) shorter than the received wavelength λ (approximately 130.4 mm), the physical influence of the feeding portion 37 of the rod antenna 30 can be reduced, and the reception performance of the antenna element board 41 of the patch antenna 40 can be maintained.

Also, according to this embodiment, by setting a ratio among the distance H1 between the antenna element board 41 of the patch antenna 40 and the roof panel 90, the distance H2 between the feeding portion 37 of the rod antenna 30 and the roof panel 90, and the distance L between the center 41A of the antenna element board 41 of the patch antenna 40 and the feeding portion 37 to 1:2:6, a layout of the antenna unit 100 can be easily designed in new development of the antenna unit 100, which contributes to reduction of a development period and development costs.

Moreover, since the displacement amount Y of the feeding point P2 can be acquired from the formula (2), the position of the feeding point where the impedance can be made to match the reference value (50Ω) can be easily set. Thus, even if the distance L between the center 41A of the antenna element board 41 and the feeding point 37 of the rod antenna 30 in the antenna unit 100 is changed, the position of the feeding point P2 according to the distance L can be easily set, and reduction of the development period of the antenna unit 100 can be realized.

Also, according to this embodiment, since the die-cast base 20 that supports the antenna element board 41 is provided so that the distance H1 between the roof panel 90 of a vehicle and the antenna element board 41 of the patch antenna 40 is to be a distance where the value of the induced voltage generated in the antenna element board 41 becomes substantially the maximum, an appropriate radiation pattern can be formed and thus the antenna directivity can be made wide and the antenna performance can be improved. Moreover, since the die-cast base 20 is provided with the supporting wall portion 22 formed projecting in the rectangular shape from the bottom face of the die-cast base 20 and the antenna element board 41 is fixed to the upper end of this supporting wall portion 22, the induced voltage generated in the antenna element board 41 is prevented from going below the antenna element board 41, and the appropriate radiation pattern as described above can be realized.

Also, according to this embodiment, since the distance H2 between the roof panel 90 of a vehicle and the feeding portion 37 is set such that the feeding portion 37 of the rod antenna 30 is not extended into the predetermined elevation angle range (20 to 160 degrees) that satisfies the antenna directivity performance of the patch antenna 40, the feeding portion 37 does not deteriorate the reception performance of the antenna element board 41 of the patch antenna 40 and the reception performance of the antenna element board 41 is maintained.

One embodiment of the present invention has been explained, but the present invention is not limited to that. For example, in this embodiment, the rod antenna 30 is an antenna that receives the AM/FM radio broadcasting and the patch antenna 40 is an antenna that receives the satellite radio broadcasting, but not limited to that, the rod antenna 30 may be an antenna that receives TV broadcasting. Also, the patch antenna 40 may be an antenna that receives a GPS signal or an antenna that transmits/receives ETC data.

Also, in this embodiment, the case in which the antenna unit 100 is attached to the roof panel 90 of a vehicle has been explained, but it is needless to say that the antenna unit can be attached to an appropriate place as long as it is a car-body panel.

REFERENCE SIGNS LIST

10 base plate
20 die-cast base (supporting member)
21 boss portion
22 supporting wall portion
30 rod antenna
31 booster circuit board
34 connection plate
36 antenna element
36A base end portion
37 feeding portion
40 patch antenna
41 antenna element board
41A center
42 LNA circuit board
43 flange portion
48 output cable
50 case body
50A rear end portion
55 cover body
90 roof panel
100 antenna unit (composite antenna device)
L distance
∈r specific permittivity
H1 distance
H2 distance
P2 feeding point

The invention claimed is:

1. A composite antenna device comprising:

a rod antenna for receiving a radio wave of a first frequency band; and a patch antenna for receiving a radio wave of a second frequency band higher than the first frequency band, wherein:

the patch antenna is arranged side by side at a position with a distance L from the rod antenna shorter than a wavelength of the radio wave of the second frequency band, a feeding point that supplies power to the patch antenna is disposed at a position displaced from one end of the patch antenna by a distance Y, and the distance Y satisfies: $Y \approx L/\epsilon r^{1/2}$, where a specific permittivity of the patch antenna is ∈r.

2. The composite antenna device according to claim 1, wherein a supporting member that supports the patch antenna is provided so that a distance between a base plate on which the composite antenna device is mounted and the patch antenna is to be a distance where a value of an induced voltage generated in the patch antenna becomes substantially the maximum.

3. The composite antenna device according to claim 1, wherein a distance between a base plate on which the composite antenna device is mounted and a feeding portion of the rod antenna is set such that the feeding portion of the rod antenna does not extend into a predetermined elevation angle range that satisfies antenna directivity performance of the patch antenna.

4. The composite antenna device according to claim 1, wherein the first frequency band includes a frequency band of a radio wave of AM/FM broadcasting.

5. The composite antenna device according to claim 1, wherein the second frequency band includes a frequency band of a radio wave of satellite broadcasting transmitted from a satellite.

* * * * *